United States Patent [19]

Buckley et al.

[11] 4,271,786

[45] Jun. 9, 1981

[54] ELECTROPHOTOCOPIER DEVELOPER UNIT MOUNTING SYSTEM

[75] Inventors: Franklin J. Buckley, Bethel; David W. Hubbard, Stamford, both of Conn.

[73] Assignee: Pitney-Bowes, Inc., Stamford, Conn.

[21] Appl. No.: 159,904

[22] Filed: Jun. 16, 1980

[51] Int. Cl.[3] ..... G03G 15/09

[52] U.S. Cl. ..... 118/661; 101/247; 118/262; 118/657; 355/3 DD

[58] Field of Search ..... 118/661, 658, 262, 657; 101/247; 355/3 DD, 10

[56] References Cited

U.S. PATENT DOCUMENTS

| | | | |
|---|---|---|---|
| 1,584,578 | 5/1926 | Widenmann et al. | 101/247 |
| 2,730,044 | 1/1956 | Harrison | 101/247 X |
| 3,627,557 | 12/1971 | Sato et al. | 118/661 X |
| 3,907,423 | 9/1975 | Hayashi et al. | 355/10 |
| 3,948,217 | 4/1976 | Forward | 118/658 |
| 3,953,121 | 4/1976 | Reichart, Jr. | 118/658 X |

OTHER PUBLICATIONS

Williams, E. M., *Mechanically Compliant (Self-Adjusting) Developer Unit,* IBM Technical Disclosure Bulletin, vol. 19, No. 10, Mar. 1977, pp. 3865-3867.

*Primary Examiner*—Evan K. Lawrence

*Attorney, Agent, or Firm*—Lawrence E. Sklar; William D. Soltow, Jr.; Albert W. Scribner

[57] ABSTRACT

A mounting system for a developer unit in an electrophotocopier having a photoreceptor mounted on a drum for assuring proper alignment and pressure between the developer unit and the photoreceptor drum. The mounting system comprises a fixed platform having a rectangular slot located midway between the ends thereof, said slot having a length extending perpendicular to the axis of the photoreceptor drum, a developer unit slidably mounted at either end on said fixed platform, the developer unit having a base plate with an aperture in alignment with the rectangular slot, a pair of spacer wheels coaxial to and slightly larger in diameter than the applicator shell on the developer unit rotatably mounted on either end of the developer unit, means for urging the spacer wheels against the photoreceptor drum, and a locking and guiding device removably insertable in said rectangular slot in said fixed platform. The locking and guiding device includes a rotatable pin having a cap portion and a shank portion, the shank portion being reciprocably slidable in both the aperture and the slot, a compression spring located beneath the cap portion and above the base plate and surrounding the upper part of the shank portion of the pin, and a cam-lock fixedly secured to the bottom of the shank portion having a configuration such that the cam-lock may pass through the rectangular slot and upon rotation be locked into sliding engagement with the length of the rectangular slot.

4 Claims, 7 Drawing Figures

ELECTROPHOTOCOPIER DEVELOPER UNIT MOUNTING SYSTEM

BACKGROUND OF THE INVENTION

The instant invention relates to dry, electrostatic copiers having a developer unit with a brush for depositing toner particles on the surface of a photoreceptor. More particularly, the invention relates to the mounting apparatus formed in such copiers for mounting the developer unit adjacent the photoreceptor.

Electrostatic copiers are known which employ a photoconductive element (photoreceptor), such as a zinc oxide coated web, for developing a visible image of a document to be reproduced. In such a device, a latent image is first formed on the surface of the photoreceptor by depositing electrostatic charges thereon and selectively dissipating certain charges to form a charge pattern corresponding to the original document. A dry, visible toner powder is then distributed onto the charged surface of the photoreceptor, customarily by means of a magnetic brush which rotates about an axis parallel to the transverse direction of the photoreceptor. By the mechanism of electrostatic attraction, the distributed toner particles adhere to the electrostatic charges on the photoreceptor, thereby rendering the latent image visible. This visible image is then ordinarily transferred to a second surface, such as a sheet of paper, and fixed thereon by heating.

While there are many determining factors which influence the quality of the developed image, given a substantially uniform surface charge distribution, the single most significant factor determining image quality is the degree of uniformity with which the toner powder is distributed on the surface of the photoreceptor. Many copiers employ magnetic brush development units for distributing the toner. In a typical arrangement, the brush consists of a magnetized core member, such as a permanently magnetized cylinder, and magnetic particles, such as iron filings, which are attracted by magnetic forces to the surface of the core, forming brushlike tufts or streamers on the surface thereof. The brush is ordinarily encased in a developer unit which also carries components for mixing the toner powder with the magnetic particles (two component toner). In operation, the toner powder is introduced into the mixing portion of the developer unit where it is thoroughly intermixed with the magnetic particles. During mixing, particles of toner are attracted by and adhere to the magnetic particles by triboelectric forces therebetween. The toner bearing magnetic particles are then swept over the charged photoreceptor by the brush core. Those toner particles which encounter electrostatic charges are removed from their magnetic carriers by the force of electrostatic attraction therebetween and remain on the photoreceptor. The magnetic carrier particles are then returned by the brush core to the mixing portion of the developer unit where they acquire fresh toner particles, and the process is repeated.

It has been found that optimum results are obtained if the photoreceptor is arranged vertically in the working region, defined by the charging and developing stations in those copiers which fix the visible image on the photoreceptor (copy paper), and defined by the charging and transfer stations in those copiers which fix the visible image after transfer to a second surface. However, this arrangement introduces a critical parameter in the design of the developing station: namely, the separation distance between the surface of the charged photoreceptor and the surface of the magnetic brush core. If this distance is too great, no toner particles will approach close enough to the surface charges on the photoreceptor to be attracted thereto and the result will be an undeveloped, invisible image. On the other hand, if this distance is too small, the surface friction between the magnetic particles and the photoreceptor surface will cause great quantities of the magnetic particles to be separated from the brush core, causing partial dissipation of the charge distribution (since the magnetic particles are also electrically conductive), fouling of machine components located below the developing station and an excessive deposition of toner particles onto the photoreceptor surface which results in an exceedingly dark and sometimes completely black developed image. In between these two extremes lies an optimum spacing which varies accordingly to the desired image contrast, the magnetic field strength at the brush core surface, the permeability and linear dimensions of the magnetic particles, the strength of the triboelectric forces between the toner and magnetic particles, and other factors. Once achieved, this optimum spacing must be rigidly maintained to ensure good copy quality.

The foregoing problems become even more acute with the use of a single component toner (so-called because there is no separate magnetic carrier particle), thereby making proper registration between the photoreceptor and the developer unit all the more critical. It is also desirable to be able to retract the developer unit to facilitate replacement of a photoreceptor belt, and to be able to completely remove the developer unit from the copier housing. The foregoing objectives are all achieved by the instant invention, which provides for alignment of the developer unit in three mutually perpendicular directions and facilitates removal of the developer unit from the copier housing.

SUMMARY OF THE INVENTION

The instant invention provides, accordingly, a mounting system for a developer unit in an electrophotocopier having a photoreceptor mounted on a drum for assuring proper alignment and pressure between the developer unit and the photoreceptor drum. The mounting system comprises a fixed platform having a rectangular slot located midway between the ends thereof, said slot having a length extending perpendicular to the axis of the photoreceptor drum, a developer unit slidably mounted at either end on said fixed platform, the developer unit having a base plate with an aperture in alignment with the rectangular slot, a pair of spacer wheels coaxial to and slightly larger in diameter than the applicator shell on the developer unit rotatably mounted on either end of the developer unit, means for urging the spacer wheels against the photoreceptor drum, and a locking and guiding device removably insertable in said rectangular slot in said fixed platform. The locking and guiding device includes a rotatable pin having a cap portion and a shank portion, the shank portion being reciprocably slidable in both the aperture and the slot, a compression spring located beneath the cap portion and above the base plate and surrounding the upper part of the shank portion of the pin, and a cam-lock fixedly secured to the bottom of the shank portion having a configuration such that the cam-lock may pass through the rectangular slot and upon rotation be locked into sliding engagement with the length of the rectangular slot.

DETAILED DESCRIPTION

Figure 1:
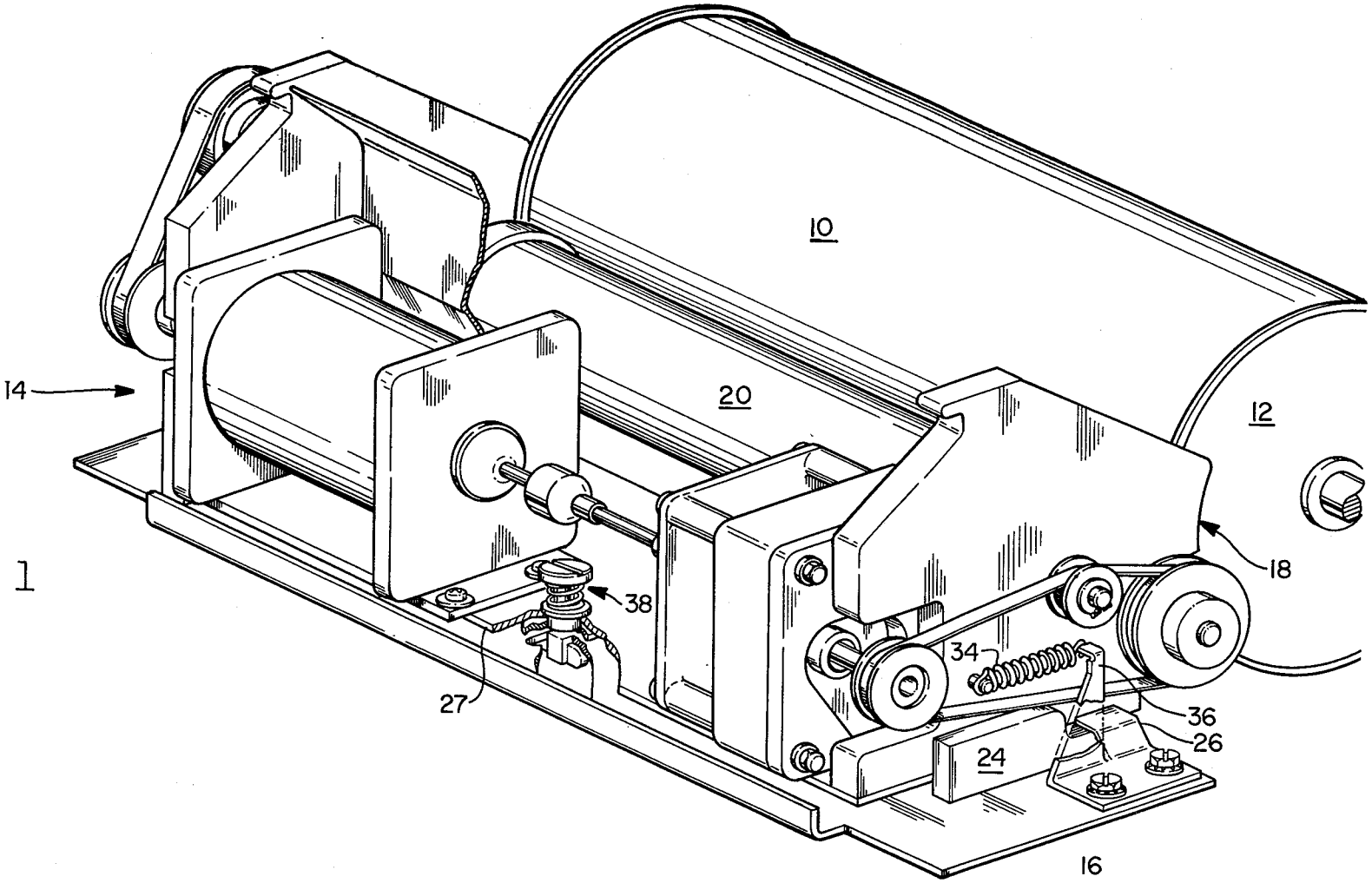
FIG. 1 is a perspective view of a photoreceptor mounted on a drum and a developer unit mounted according to the instant invention.

In describing the preferred embodiment of the instant invention, reference is made to the drawings, wherein there is seen a photoreceptor belt 10 rotatably supported by a drive roller or drum 12 and an idler roller (not shown). Disposed adjacent the photoreceptor belt 10 is a developer unit generally designated 14 mounted on a platform 16 fixed to the housing for the electrophotocopier (not shown). The developer unit 14 includes a hopper 18 for holding a supply of toner material (not shown) and an applicator shell 20 for picking up toner material and carrying it into contact with the photoreceptor belt 10. The platform 16 includes a rectangular slot 22 located midway between the ends of the platform 16. The slot 22 has a length corresponding to its sides L (see FIGS. 3 and 6) extending perpendicular to the axis of the photoreceptor drum 12.

Figure 7:
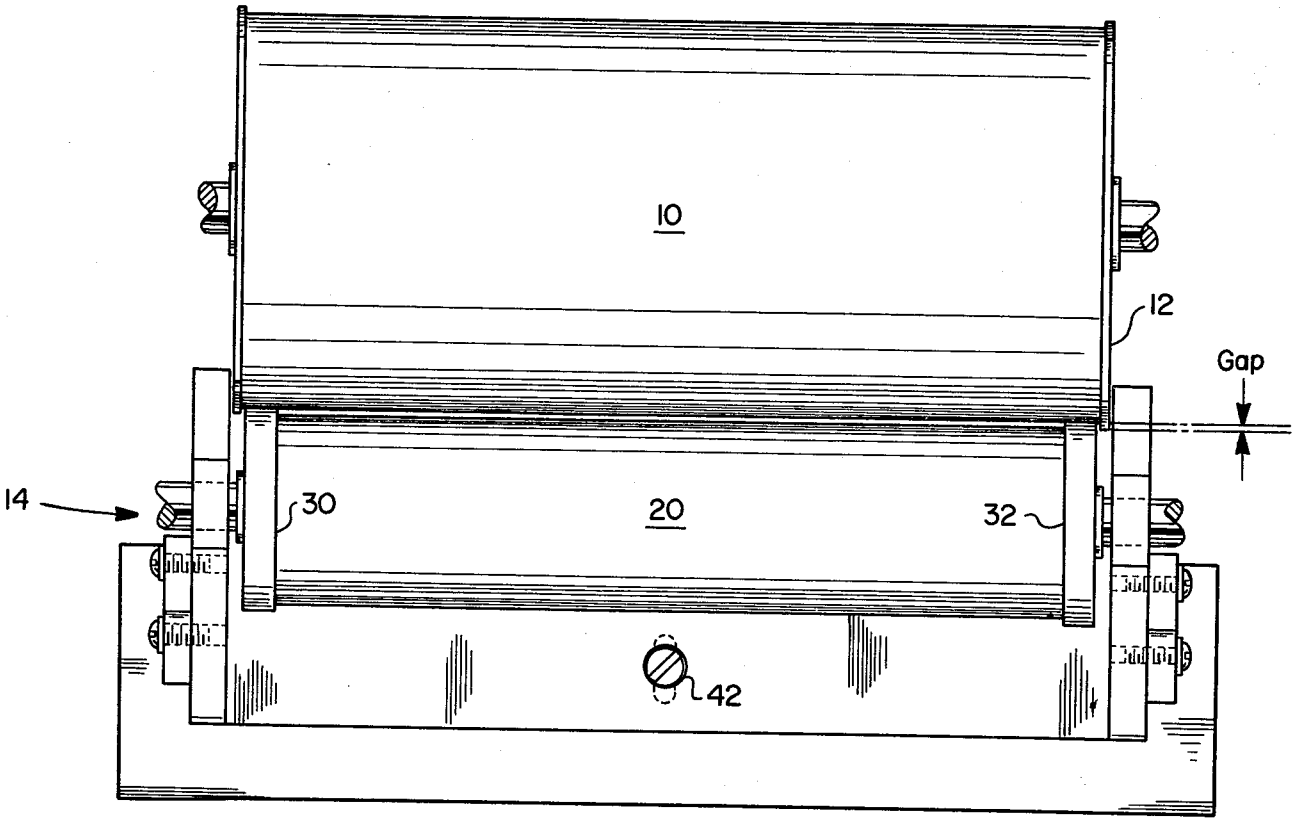
FIG. 7 is a top plan view of the photoreceptor drum and developer unit shown in FIG. 1.

The developer unit 14 includes a pair (only one is shown) of supporting members 24 at either end thereof for slidably mounting the developer unit 14 on the platform 16. A pair (only one is shown) of angled guide members 26 are fixedly secured to the platform 16 and receive the supporting members 24. The developer unit 14 further includes a base plate 27 having an aperture 28 in alignment with the rectangular slot 22. As best seen in FIG. 7, a pair of spacer wheels 30 and 32 are rotatably mounted on either end of the developer unit 14. The spacer wheels 30 and 32 are coaxial to and slightly larger in diameter than the applicator shell 20. A pair of compression springs 34 (only one is shown) extending from a pair of flange members 36 (only one is shown) to the sides of the developer unit 14 urge the developer unit towards the photoreceptor drum 12, so that the spacer wheels 30 and 32 rotatingly engage the photoreceptor 10 but outside of the imaging area.

Engaging the rectangular slot 22 and the aperture 28 is a locking and guiding device generally designated 38, which includes a rotatable pin 40 having a cap portion 42 and a shank portion 44, the cap portion 42 including a slot 43. A compression spring 46 is located beneath the cap portion 42 and above the base plate 27. Housed in the aperture 28 is a bushing 48, preferably formed from a plastic, the top portion of which supports the lower portion of the compression spring 46. Situated between the base plate 27 and the platform 16 is a washer 50, and located beneath the base blate 27 and the washer 50 is a cam-lock 52 fixedly secured to the bottom part of the shank portion 44 of the rotatable pin 40.

Figure 2:
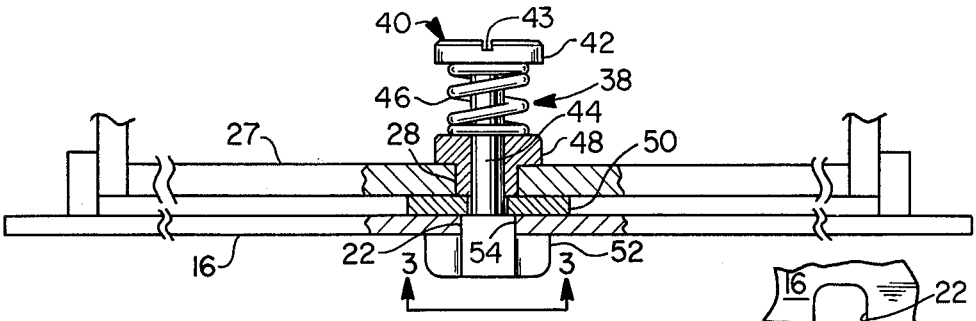
FIG. 2 is an enlarged, vertical sectional view of a locking and guiding device for the developer unit according to the instant invention.
Figure 3:
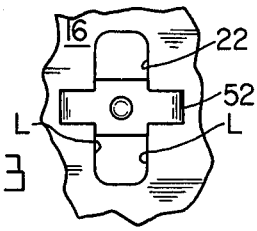
FIG. 3 is a view taken on the horizontal plane indicated by the line 3—3 in FIG. 2.
Figure 4:
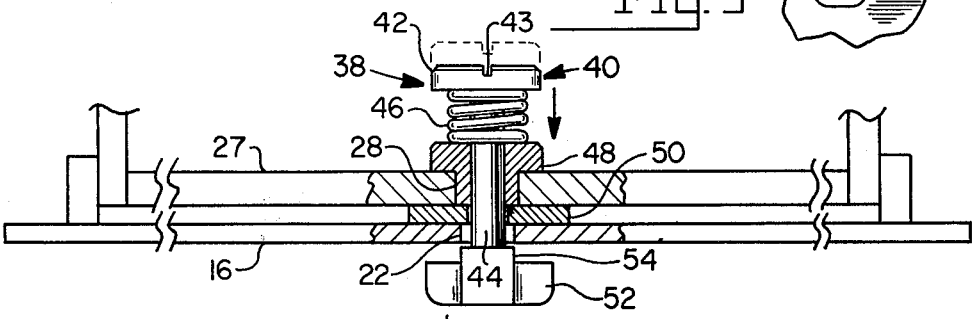
FIG. 4 is similar to FIG. 2 except it shows the locking and guiding device in a depressed position preparatory to separation of the developer unit.
Figure 6:
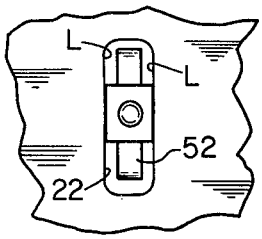
FIG. 6 is a view taken on the horizontal plane indicated by the line 6—6 in FIG. 5.

The cam-lock 52, as best seen in FIGS. 3 and 6, is rectangular in a plan view so that it may be passed through the rectangular slot 22 when rotated to the position shown in FIG. 6. By rotating the cam-lock 52 90 degrees to the position shown in FIG. 3, the cam-lock 52 becomes fixed below the platform 16 and cannot slip through the rectangular slot 22. As best seen in FIGS. 2 and 4, the top portion 54 of the cam-lock 52 is recessed on two opposing sides in order that the top portion 54 of the cam-lock 52 may cammingly engage the sides L of the rectangular slot 22.

Figure 5:
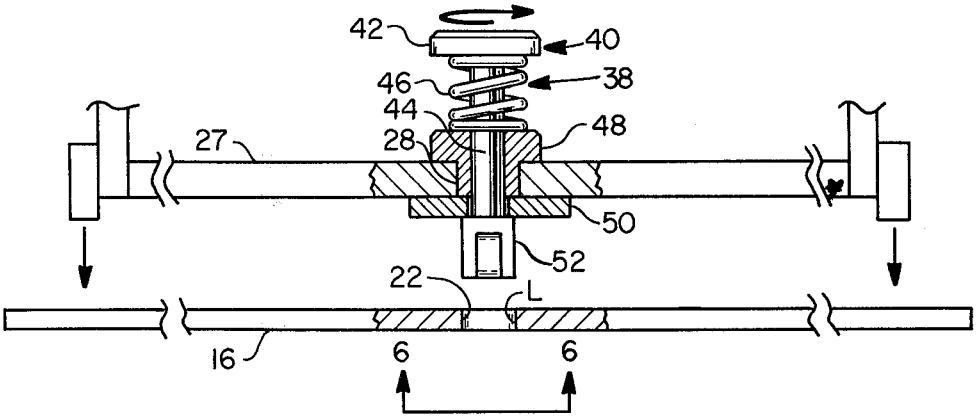
FIG. 5 is similar to FIG. 2 except it shows the separation of the developer unit.

To understand the functioning of the locking and guiding device 38, reference is now made to FIG. 2 which shows the device 38 in its normal, operational position, wherein the cam-lock 52 is situated beneath the platform 16 and arranged so that the cam-lock 52 bridges the width of the rectangular slot 22 as seen in FIG. 3. In FIG. 4, the cap portion 42 of the rotatable pin 40 has been manually depressed against the compression spring 46, thereby freeing the top portion 54 of the cam-lock 52 from its camming engagement with the sides L of the rectangular slot 22. In FIG. 5, the cap portion 42 of the rotatable pin 40 has been rotated 90 degrees, thereby enabling the cam-lock 52 to be pulled up through the rectangular slot 22 and thereby allowing the developer unit 14 to be separated from the platform 16 and removed from the photocopier housing if so desired.

The developer unit 14 is aligned with respect to the photoreceptor belt 10 in three mutually perpendicular directions. Since the locking and guiding device 38 can move closer or further away from the photoreceptor belt by virtue of the cam-lock 52 riding in the slot 22, the spacing between the developer unit 14 and the belt 10 is determined by the springs 34 and the spacer wheels 30 and 32. Looking at FIG. 2, the left to right alignment of the developer unit 14 is governed by the sides L, while the vertical alignment of the developer unit 14 is determined by the locking and guiding device 38, particularly the thickness of the washer 50.

While this invention has been described with reference to the structure disclosed herein, it is not confined to the details set forth, and this application is intended to cover such modifications or changes as may come within the purposes of the improvements of the scope of the following claims.

What is claimed is:

1. A mounting system for a developer unit in an electrophotocopier having a photoreceptor mounted on a drum for assuring proper alignment and pressure between the developer unit and the photoreceptor, comprising:

a fixed platform having a rectangular slot located midway between the ends thereof, said slot having a length extending perpendicular to the axis of the photoreceptor drum;

a developer unit slidably mounted at either end on said fixed platform, said developer unit having a base plate with an aperture in alignment with said rectangular slot;

a pair of spacer wheels coaxial to and slightly larger in diameter than the applicator shell on the developer unit rotatably mounted on either end of the developer unit;

means for urging said spacer wheels against the photoreceptor drum; and a locking and guiding device removably insertable in said slot in said fixed platform, said device including a rotatable pin having a cap portion and a shank portion, said shank portion being reciprocably slidable in both said aperture and said slot, a compression spring located beneath the cap portion and above the base plate and surrounding the upper part of the shank portion of said pin, and a cam-lock fixedly secured to the bottom of said shank portion having a configuration such that said cam-lock may pass through said rectangular slot and upon rotation be locked into sliding engagement with the length of said rectangular slot.

2. The mounting system of claim 1, wherein the cam-lock is rectangular in a view taken perpendicular to the axis of the rotatable pin.

3. The mounting system of claim 2, wherein the top portion of the cam-lock is recessed on two opposing sides such that the top portion of the cam-lock may cammingly engage the sides of the rectangular slot.

4. The mounting system of claim 3, wherein the urging means comprises a pair of compression springs operatively connected to the fixed platform and the sides of the developer unit.

* * * * *